US008904838B2

(12) United States Patent
Havemann et al.

(10) Patent No.: US 8,904,838 B2
(45) Date of Patent: Dec. 9, 2014

(54) LOCK DEVICE

(71) Applicant: Volkswagen AG, Wolgsburg (DE)

(72) Inventors: Joerg Havemann, Bad Bodenteich (DE); Helge Winkler, Boesdorf (DE)

(73) Assignee: Volkswagen AG, Wolfsburg (DE)

( * ) Notice: Subject to any disclaimer, the term of this patent is extended or adjusted under 35 U.S.C. 154(b) by 0 days.

(21) Appl. No.: 13/764,161

(22) Filed: Feb. 11, 2013

(65) Prior Publication Data

US 2013/0152648 A1 Jun. 20, 2013

Related U.S. Application Data

(63) Continuation of application No. PCT/EP2011/003996, filed on Aug. 10, 2011.

(30) Foreign Application Priority Data

Aug. 10, 2010 (DE) ..... 10 2010 033 904

(51) Int. Cl.
*E05B 15/14* (2006.01)
*E05B 29/00* (2006.01)
*E05B 19/00* (2006.01)

(52) U.S. Cl.
CPC ..... *E05B 29/0033* (2013.01); *E05B 19/0058* (2013.01); *E05B 29/00* (2013.01)
USPC ..... 70/377; 70/392; 70/492

(58) Field of Classification Search
USPC ..... 70/377, 392, 409, 419, 492, 495
See application file for complete search history.

(56) References Cited

U.S. PATENT DOCUMENTS

| | | | | | |
|---|---|---|---|---|---|
| 1,406,574 | A | * | 2/1922 | Mantan | 70/492 |
| 2,123,940 | A | * | 7/1938 | Gray | 70/492 |
| 4,292,823 | A | * | 10/1981 | Reinhard et al. | 70/492 |
| 4,750,342 | A | * | 6/1988 | Nakai | 70/496 |
| 4,972,695 | A | | 11/1990 | Mochida et al. | |

(Continued)

FOREIGN PATENT DOCUMENTS

| | | | |
|---|---|---|---|
| DE | 0 203 840 | A2 | 12/1986 |
| DE | 203 12 238 | U1 | 10/2003 |
| DE | 103 13 125 | A1 | 10/2004 |
| DE | 10 2008 032 303 | A1 | 1/2010 |

(Continued)

OTHER PUBLICATIONS

Japanese Office Action for parallel Japanese application dated Aug. 22, 2014—English translation.

*Primary Examiner* — Christopher Boswell
(74) *Attorney, Agent, or Firm* — Muncy, Geissler, Olds & Lowe, P.C.

(57) ABSTRACT

A lock device having a lock cylinder and a flat key having a control gate. The lock cylinder has a cylinder housing and a cylinder core rotationally supported in the cylinder housing and a plurality of plate-shaped tumblers that are supported in the cylinder core so as to be radially slidable with respect to the rotational axis of the cylinder core and which each have a key opening and are at least partially pushed by the spring load into a locking channel of the cylinder housing in order to lock the lock cylinder when the flat key is removed and which are slid into an unlocking position by the control cam guided in the control gate when the key is inserted. At least one stop is associated with each of the tumblers in order to limit the sliding path to conceal the unlocking position.

9 Claims, 3 Drawing Sheets

(56) References Cited

U.S. PATENT DOCUMENTS

| | | | | |
|---|---|---|---|---|
| 5,088,305 | A * | 2/1992 | Myers | 70/369 |
| 5,438,856 | A * | 8/1995 | Richter et al. | 70/492 |
| 5,600,981 | A * | 2/1997 | Sievert | 70/492 |
| 5,970,762 | A * | 10/1999 | Myers et al. | 70/492 |
| 2003/0037582 | A1 * | 2/2003 | Edwards et al. | 70/495 |
| 2007/0006623 | A1 | 1/2007 | Barrenberg et al. | |

FOREIGN PATENT DOCUMENTS

| | | | | |
|---|---|---|---|---|
| EP | 879927 | A1 * | 11/1998 | E05B 29/00 |
| FR | 2 276 447 | | 1/1976 | |
| FR | 2 717 526 | A1 | 9/1995 | |
| GB | 2 028 910 | A | 3/1980 | |
| JP | H 07-150829 | A | 6/1995 | |
| WO | WO 2004/085772 | A1 | 10/2004 | |

* cited by examiner

LOCK DEVICE

This nonprovisional application is a continuation of International Application No. PCT/EP2011/003996, which was filed on Aug. 10, 2011, and which claims priority to German Patent Application No. DE 10 2010 033 904.0, which was filed in Germany on Aug. 10, 2010, and which are both herein incorporated by reference.

BACKGROUND OF THE INVENTION

1. Field of the Invention

The invention relates to a lock device with a lock cylinder and a flat key having a control gate.

2. Description of the Background Art

Conventional lock devices are known from the prior art. High demands are placed on such lock devices with regard to security against break-in, so that simple reading out of the unlocking positions of the different tumblers should be prevented. A tumbler typically has locking edges on both sides that project into a specific locking channel of the cylinder housing in the locking position. In this design, the locking edges are designed such that they are flush with the cylinder core or its outer circumferential edge in at least one position of the tumbler so that in this position they permit the cylinder core to rotate. This position is hence also referred to as the unlocking position of the tumbler. Without special precautions, the unlocking position of the tumblers can be probed, for example directly in the keyway from the rest positions of the tumblers with the flat key removed, or indirectly by determining the length of the applicable return travel of each tumbler when the individual tumblers are successively pushed back in opposition to their spring loading using a tool. Using the data thus obtained, an unauthorized person can then ascertain the control gate required for unlocking and produce a matching duplicate key.

To increase security, it is known to provide such lock devices with read-out protection that conceals the unlocking position of the tumblers. For example, an advantageous read-out protection is disclosed in DE 103 13 125 A1, which corresponds to U.S. Pat. No. 2007006623. Here, provision is made to equip the tumblers with at least one stop that restricts the displacement travel of the relevant tumbler in the cylinder core in at least one of the two directions of displacement. This achieves the result that, when the key is removed, the relevant tumbler is pushed or moved to the stop by spring loading, independently of how far it projects into a locking channel. Consequently, it is not possible to deduce the location of the locking edges of the relevant tumbler by probing the displacement travels of the tumblers. The control gate of the flat key is equipped with control edges that displace the tumblers by a desired number of increments when the flat key is inserted into the passage formed by the key openings. The maximum displacement travel of the tumblers in this design is divided into uniform increments that are specified by the control gate. In particular, different codings for the lock cylinder can be implemented by the number of increments as well as by the number of tumblers.

SUMMARY OF THE INVENTION

It is therefore an object of the invention to provide a lock device that can be manufactured both simply and inexpensively and that offers especially high security against reading-out of the unlocking positions.

In an embodiment, a lock device has a lock cylinder and a flat key having a control gate, wherein the lock cylinder includes a cylinder housing and a cylinder core rotatably supported therein as well as multiple plate-shaped tumblers supported in the cylinder core so as to be movable radially with respect to the axis of rotation of the cylinder core, each of which tumblers has a key opening with a control cam and is at least partially pushed into a locking channel of the cylinder housing by spring loading to lock the lock cylinder when the flat key is removed, and is moved into an unlocking position by the control cam guided in the control gate when the key is inserted, and wherein each of the tumblers is provided with at least one stop to limit the displacement travel in at least one direction of displacement to conceal the unlocking position.

Thus, the stop of at least one tumbler is implemented/arranged such that this tumbler is pushed into its unlocking position by the spring loading when the key is removed. Provision is thus made that the rest position of the one tumbler corresponds to its unlocking position in the cylinder core. Although this tumbler in its rest position does not contribute to locking the lock cylinder since it is in its unlocking position, it not only makes reading out the lock cylinder more difficult, but also offers the possibility of providing an additional increment. Because the one tumbler in its rest position is in its unlocking position, it is not necessary to provide the control gate of the flat key with an increment to move this tumbler into its unlocking position. Preferably, at least a portion of the control cams and/or keyways are designed such that they are aligned with one another with the key removed. This further increases the difficulty of reading out the unlocking positions. While the control cams and/or keyways of the certain tumblers are aligned with one another, these certain tumblers preferably project different distances into the locking channel with their locking edges.

The one tumbler can be the particular tumbler among the tumblers that stands in its unlocking position at the lowest step of the control gate. This ensures the largest possible number of increments for the control gate. An alternate channel can be located opposite the locking channel and can be designed such that it corresponds to the largest possible displacement travel of the one tumbler. In this way, the corresponding locking edge of the first tumbler can be pushed through the maximum displacement travel from the unlocking position into the alternate channel. In this design, the tumblers can all be spring-loaded in the same direction or in different, opposite directions, wherein the alternate channel preferably constitutes an additional locking channel and the locking channel preferably constitutes an additional alternate channel.

In an ebodiment, at least the one tumbler, in particular all tumblers, terminate flush with the cylinder core on both sides in their respective unlocking positions. In this design, the shape of the locking edges preferably is matched to the cylinder core and has a radius that at least largely corresponds to the radius of the outer circumferential surface of the cylinder core. The flush termination of the tumblers and the locking edges with the cylinder core in the unlocking position achieves the result that reliable locking of the lock cylinder takes place for every deviation from the unlocking position.

According to an embodiment of the invention, provision is made for the stop of at least one other tumbler to be designed/configured such that the other tumbler can be maximally displaced into its unlocking position in opposition to the spring loading. This further increases the difficulty of reading out the unlocking positions. In particular, this cuts off the displacement travel to the spring stop that typically remains, so that it is not usable. The design of the other tumbler can also be provided as an alternative to the design of the one tumbler described above.

The control cam and/or the key opening of the one or the other tumbler can be flush with the key opening and/or the control cam of at least one additional tumbler when the key is removed. This ensures the read-out protection described above, which prevents simple reading out of the unlocking positions based on the rest positions of the tumblers.

In an embodiment, all tumblers can be displaceable by the same maximum displacement travel. In particular, this is important for the control gate of the flat key, which must be designed such that the flat key can also actually be fully inserted into the keyway formed by the key openings and is not prevented from doing so by a tumbler that cannot be displaced further. In particular, the maximum displacement travel is divided into uniform increments, which are specified by the control gate of the flat key. However, the increments here need not be provided in ascending or descending order; rather, as in the conventional manner, increments are provided at different places in the control gate, so that an increment can also be a multiple of an adjacent increment.

An embodiment of the invention provides for the stop of at least one tumbler to be implemented as a laterally projecting cam. The cam can be designed as a single piece with the tumbler and can project into a recess of the cylinder core. The tumblers are each movably supported in a shaft provided in the cylinder core. This shaft can be provided on the side with the recess into which the cam projects in the installed state. The height of the recess in the direction of displacement limits the maximum displacement travel over which the relevant tumbler can be displaced in the cylinder core. The recess forms two matching stops that work together with stops of the tumbler formed by the cam. For the at least one first tumbler, the recess and the cam are located and oriented such that the tumbler is located in its unlocking position with the spring uncompressed and the cam displaced against one of the matching stops, and terminates flush with the cylinder core, in particular on both sides.

Additionally or as an alternative, provision can be made for the at least one stop of at least one tumbler to be implemented via one of its locking edges, in particular via at least one bevel implemented in the locking edge. In this case, the maximum displacement travel of the corresponding tumbler is limited by the contact of the locking edge with the inside of the locking channel. In order to ensure concealment of the unlocking positions and the implementation of the locking edges here, as well, the locking edge preferably has the at least one bevel, which in particular operates together with a correspondingly shaped bevel of the locking channel in order to limit the maximum depth of entry of the tumbler into the locking channel. Preferably, each of the two locking edges of the tumbler forms a stop, in particular via at least one bevel formed by the locking edge. Preferably, the interruption of the locking edge formed by the bevel is implemented in the center of the locking edge.

In an embodiment, the relevant locking edge can have a recess, in particular the recess having at least one bevel, to accommodate in certain regions a matching stop, in particular having at least one matching bevel, of the locking channel. Thus, it is possible to provide a web that extends through the entire locking channel and has beveled side surfaces that work together with the receptacle of the relevant tumbler. The preferred provision of equal angles between the bevels and matching bevels in each case makes it possible to determine different depths of entry for the tumblers in the locking channel solely by providing different depths for the receptacles in the locking edges of the tumblers. Preferably, the one or more receptacles are centrally located in the locking edge.

In an embodiment, the lock cylinder can be equipped with a freewheel system. The freewheel system can be designed such that when a torque is applied to the cylinder core, the cylinder core will rotate without rotationally carrying along an associated locking mechanism if at least one of the tumblers is not in its unlocking position. Freewheel systems are known in principle, so they are not described in detail here.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
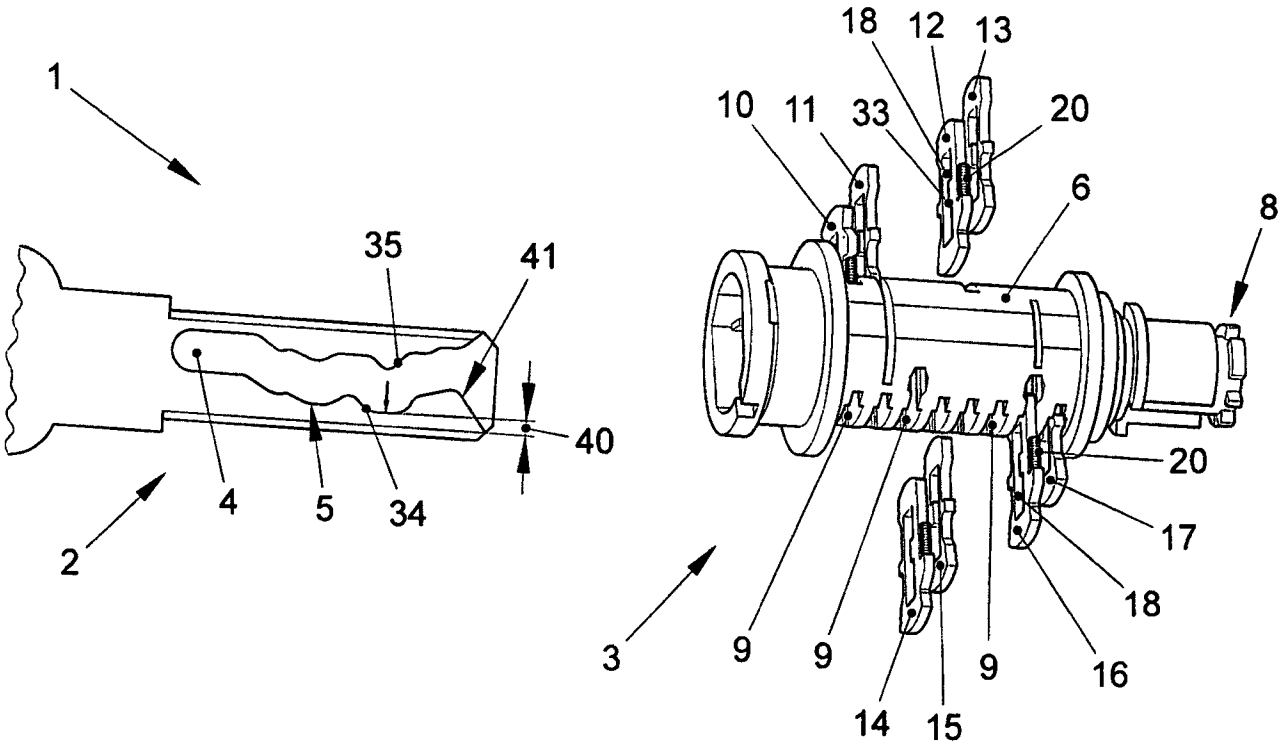
FIG. 1 shows a lock device in a perspective view.

FIG. 1 shows a perspective, exploded view of a lock device 1, comprising a flat key 2 and a lock cylinder 3. The flat key 2 has a recess 4 in its lateral surface that forms a control gate 5. The control gate 5 defines the steps and the increments by which each of the tumblers is displaced, wherein the increments are uniformly distributed over the entire maximum displacement travel.

The lock cylinder 3 has one cylinder core 6 shown, which is rotatably supported in a cylinder housing 7 that is shown in the other figures. At one end, the cylinder core 6 has rotary carrier component 8 that serves to transmit a rotary motion or rotation of the cylinder core 6 to a lock mechanism that is not shown here. At the opposite end from the rotary carrier component 8, the cylinder core 6 is open to accommodate the flat key 2.

Moreover, the cylinder core 6 is designed to be largely hollow or implemented as a cylindrical sleeve. Perpendicular to its axis of rotation, the cylinder core has multiple shafts 9 arranged parallel to one another, of which only one is provided with reference symbols here for reasons of clarity. A plate-shaped tumbler 10 to 17 is held in each of the shafts 9 so as to be radially movable and spring-loaded in one of the directions of displacement. In this design, the tumblers 10 to 17 are sorted or arranged such that the tumblers 10 to 13 are spring-loaded in one direction of displacement, while the tumblers 14 to 17 are spring-loaded in the other direction of displacement. Each of the tumblers has a key opening 18; in the assembled state, said key openings together form a keyway 19 to accommodate the flat key 2.

Figure 2C:
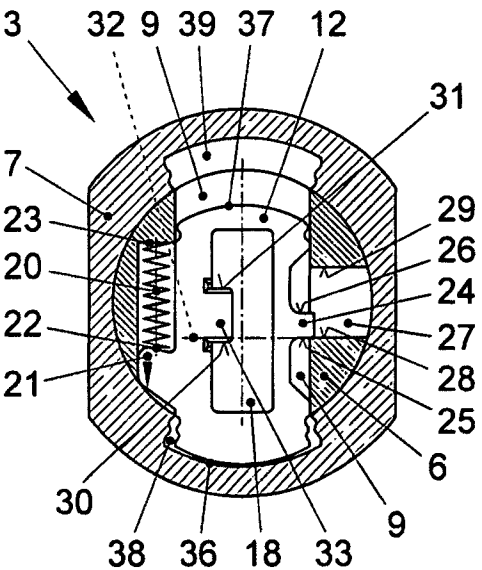
FIGS. 2A to 2C show cross-sectional views through a lock cylinder of the lock device in the region of different tumblers.
Figure 2B:
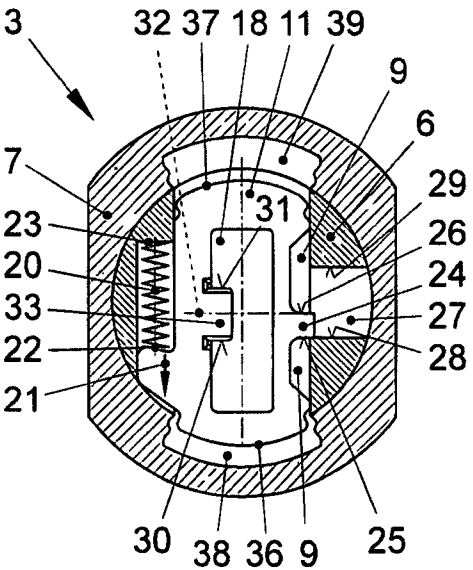
Figure 2A:
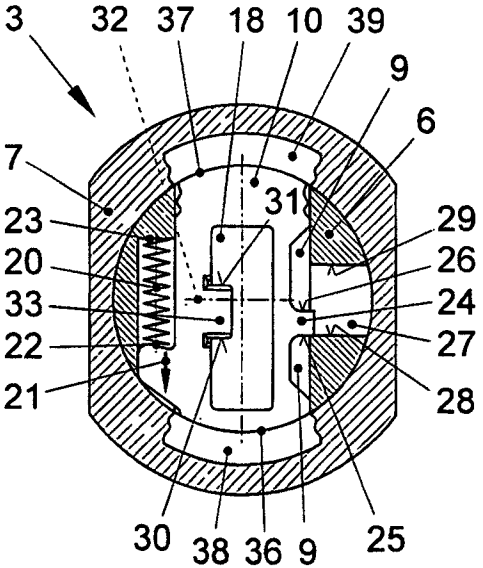

FIGS. 2A to 2C show cross-sections through the lock cylinder 3 in the region of the tumblers 10 (FIG. 2A), 11 (FIG.

2B), and 12 (FIG. 2C), wherein the fundamental construction is explained in detail below, firstly with regard to the tumbler 10 using FIG. 2A.

FIG. 2A shows the tumbler 10 supported in the cylinder core 6 so as to be radially movable. The outer contour of the cylinder core 6 here is matched to the inner contour of the cylinder housing 7 to form a plain bearing. A spring element 20 is held compressed between the cylinder core 6 and the tumbler 10, and pushes the tumbler 10 in a first direction of displacement under spring loading as indicated by an arrow 21. In this design, the spring element is held between a laterally projecting spring bar of the tumbler 10 and a spring bar 23 of the cylinder core 6.

On the side of the tumbler 10 opposite the spring element 20, said tumbler has a laterally projecting cam 24 forming first and second stops 25 and 26, which are designed as flat top and bottom surfaces. The cam 24 projects into portions of a recess 27 of the cylinder core 6. The cam 24 thus extends beyond the side surface of the shaft 9 into the recess 27. The arrangement of the end stop components 25 and 26 and of the cam 24, and the height of the recess 27 determine the maximum displacement travel through which the tumbler 10 can be moved/displaced in the lock cylinder 3. In the rest position shown, which is to say when the flat key 2 is removed or is not in the key opening 8, the tumbler 10 is pushed in the direction of the arrow 21 by the spring element 20 until the cam 24 and the stop 25 contact a matching stop 28 formed by the recess 27. At a maximum, the tumbler 10 can then be moved or pushed in opposition to the spring force of the spring element 20 until the stop 26 contacts a matching stop 29 formed by the recess 27.

The tumbler 10 also has control edges 30 and 31 that can assume different vertical positions relative to a height center line of the relevant tumbler labeled 32 and indicated with dotted/dashed lines, as indicated in FIGS. 2A to 3B. The control edges 30, 31 are located on a control cam 33 that projects laterally into the above-mentioned key opening 18. Even though a forced guidance of the tumbler 10 by the control gate 5 shown in FIG. 1 is possible, as the width of the control cam 33 usefully corresponds essentially to the width of the recess 4, the spring loading by the spring element 20 means that the controlling element is the control edge 30, which works together with a matching control edge 34 when the flat key is inserted. A matching control edge 35 of the control gate 5 that runs parallel to the matching control edge 34 works together in a corresponding manner essentially with the tumblers 14 to 17, which differ from the tumblers 10 to 13 only in their direction of spring loading.

Lastly, the tumbler 10 has diametrically opposed locking edges 36 and 37, which prevent rotary motion or rotation of the cylinder core 6 in the cylinder housing 7 when they project into the locking channel 38 or 39 provided in the cylinder housing 7.

The tumblers 10, 11, and 12 differ from one another, in particular, in the design or arrangement of the locking edges 36 and 37. While the locking edges 36 and 37 of all tumblers 10 to 17 have a radius that at least largely corresponds to the outer radius of the cylinder core 6, and have the same spacing from one another in each case, they differ in their location relative to the control edges 30 and 31. In their rest positions, as shown in FIGS. 2B and 2C, the tumblers 11 and 12 project different distances into the locking channel 38 with their respective locking edges 36, and to this extent correspond to prior art tumblers. The differing projection into the locking channel has the consequence that the tumblers 11 and 12 must be displaced different distances in opposition to the spring loading in order to reach their unlocking position in which the control edges 36 and 37 each terminate flush with the cylinder core 6.

In contrast to the tumblers 11 and 12, the tumbler 10 is designed such that the rest position of the tumbler 10 corresponds to its unlocking position. In other words, the control edges 36 and 37 of the tumbler 10 terminate flush with the cylinder core 6 when the key is removed and the stop 25 of the tumbler 10 is pressed against the matching stop 28 by the spring element 20. The stop 25 is thus arranged on the tumbler 10 in relation to the control edges 36 and 37 such that the tumbler is pushed into its unlocking position by the spring loading when the key is removed.

Because of the cam 24 and the recess 27, which correspondingly limit the displacement travel of the individual tumblers, it is not possible for an unauthorized person to ascertain the unlocking positions of the individual tumblers by probing them. Preferably, moreover, the key openings 18 and in particular the control cams 33 of at least some of the tumblers 10 to 13, and 14 to 17 in a corresponding manner, are aligned flush with one another in the rest position, so that no difference among the individual tumblers can be detected by viewing through the keyway 19 formed by the key openings 18. If applicable, the control cams 33 can be designed to be flush with one another in pairs, so that for example the control cams of tumblers 10 and 11 are flush with one another, and also the control cams 33 of tumblers 12 and 13, wherein preferably the control cams 33 of tumblers 12 and 13 are aligned offset by at least one increment from the control cams 33 of tumblers 10 and 11. Overall, this increases the read-out protection for concealing the unlocking positions.

In useful fashion, the tumbler 10 is the tumbler that is in its unlocking position at the lowest step of the matching control edge 34, as is shown by an arrow in FIG. 1.

Figure 3:
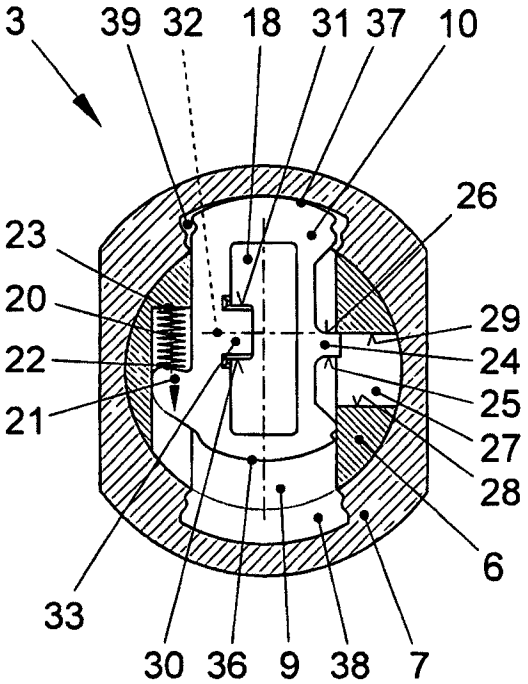
FIG. 3 shows the cross-sectional view from FIG. 2A, but with a displaced tumbler.

FIG. 3 shows the cross-section according to FIG. 2A, with the difference that the tumbler 10 is now in its maximally displaced position, so that the stop 26 rests against the matching stop 29 and the control edge 37 projects to its full length into the locking channel 39. The locking channel 39 is designed to have a corresponding depth in order to be able to accommodate the entire region of the tumbler 10 projecting beyond the cylinder core 6. It should be noted here that the locking channel 39 forms an alternate channel for tumblers 10 to 13, while the locking channel 38 simultaneously constitutes an alternate channel for tumblers 14 to 17.

Figure 4:
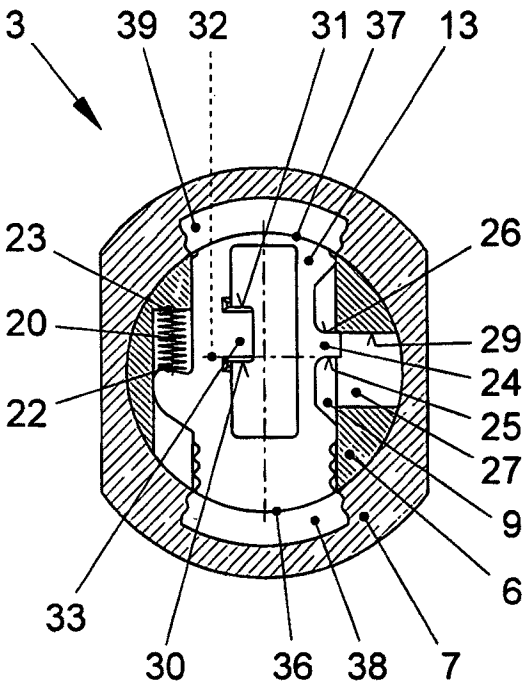
FIG. 4 shows a cross-sectional view through the lock cylinder in the region of another tumbler.

FIG. 4 shows another cross-section through the lock cylinder in the region of the tumbler 13, which differs from the other tumblers to the extent that it can be maximally displaced into its unlocking position. The stop 26 of the tumbler 13 is thus arranged or designed with regard to the locking edges 37 and 36 such that when the stop 26 contacts the matching stop 29, the tumbler 13 is located flush on both sides with the cylinder core 6, which is to say in its unlocking position. While the tumbler 10 lies flush with the cylinder core in its rest position, the tumbler 13 in its rest position thus projects into the locking channel 39 the furthest of all tumblers 10 to 13.

This, too, improves the concealment of the unlocking positions of the tumblers. Furthermore, the overall result of the lock device 1 designed in this way is an additional increment as compared with conventional lock devices in which the tumblers all project into a corresponding locking channel in their rest positions, which is to say that an additional step of the control gate 5 and a corresponding displacement position of the tumblers can be used for coding the lock cylinder. In particular, the fact that the tumbler 10 lies flush inside the cylinder core 6 in its rest position eliminates a so-called idle stroke that would have been necessary when inserting the flat key 2 into the keyway 19 in order to displace the tumbler 10 into a first step effective for unlocking. The idle stroke is indicated by a double arrow 40 in FIG. 1. The frontmost region of the flat key 2 forms a lead-in ramp 41 at the matching control edge 34, which is only partially contacted during insertion of the flat key 2 on account of the design of the tumbler 10, so that it ultimately was possible to widen the recess by an additional increment in the direction of the control edge 34.

According to an alternative embodiment that is not shown here, the stops 30 and 31 are designed or arranged in the locking edges 36 and 37 instead of on a lateral cam. In this design, it is preferable for each of the locking channels 38 and 39 to have extending through them a web that comprises two bevels extending toward one another and that is centrally located. The tumbler 11 in this design has an interruption in its control edge 36 in the form of a recess formed by two bevels tapering toward one another. The tumbler 11 can only be displaced until the web rests in the recess, so that in this case the recess constitutes the stop 30, while the web provides the matching stop 28.

On the diametrically opposite side, the web is of identical design and constitutes the matching stop 29. The locking edge 37 is interrupted by a recess that is likewise formed by two bevels tapering toward one another. If the tumbler is moved in opposition to the spring loading, its displacement travel is limited once the web is maximally introduced into the recess in the locking edge 37.

The arrangement of the locking edges 36 and 37 can be concealed in a simple manner by means of recesses extending different distances into the relevant tumbler. What is important is that the deepest points of the recesses are always made to be the same distances from one another in the relevant tumbler. In this design, a stop can be formed directly by the locking edge in one tumbler while the largest recess is formed in the corresponding locking edge on the diametrically opposite side.

The embodiments described with regard to tumblers 10 to 13 can be applied in the same manner to the tumblers 14 to 17. Naturally, the sequence of the tumblers 10 to 17 in the lock cylinder 3 can be chosen arbitrarily.

In order to increase protection against unauthorized opening of the lock cylinder 3, the lock cylinder 3 preferably has a freewheel system, not shown here, that prevents transmission of rotary motion to the rotary carrier component 8 in the event that the cylinder core 6 is violently rotated despite having at least one tumbler in the locking position.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A lock device comprising:

a flat key having a control gate; and a lock cylinder including a cylinder housing, a cylinder core rotatably supported in the cylinder housing, a plurality of plate-shaped tumblers supported in the cylinder core so as to be movable radially with respect to an axis of rotation of the cylinder core, and the cylinder core having a diameter, wherein each of the plurality of the tumblers includes:

two locking edges at longitudinal ends of the tumbler, the two locking edges including arc sides that are opposite from each other in a radial direction of the cylinder core, a key opening with a control cam, and a spring that applies a spring loading to the tumbler, at least one stop that limits the tumbler to travel in at least one direction of displacement to conceal an unlocking position, wherein one of the two locking edges of each of at least first one of the plurality of tumblers is at least partially pushed into a locking channel of the cylinder housing by spring loading to lock the lock cylinder when the flat key is removed, and the two locking edges of the each of the at least first one of the plurality of tumblers are moved into the unlocking position defined by the diameter of the cylinder core by the control cam guided in the control gate when the key is inserted, and wherein the two locking edges, including the arc sides, of each of at least second one of the plurality of tumblers are held within the diameter of the cylinder core by the spring loading when the flat key is removed.

2. The lock device according to claim 1, wherein the at least second one of the plurality of tumblers is a tumbler that stands in the unlocking position at the lowest step of the control gate.

3. The lock device according to claim 1, wherein the cylinder core includes a partially circular surface, and the at least second one of the plurality of tumblers terminates flush with the partially circular surface of the cylinder core on both locking edges in the unlocking position.

4. The lock device according to claim 1, wherein the stop of the at least first one of the plurality of tumblers is configured such that the at least first one of the plurality of tumblers is maximally displaceable into the unlocking position in opposition to the spring loading.

5. The lock device according to claim 1, wherein at least one of the key opening and the control cam of one of the plurality of tumblers is flush with at least one of the key opening and the control cam of another one of the plurality of tumblers when the flat key is removed.

6. The lock device according to claim 1, wherein the plurality of tumblers are all displaceable by the same maximum displacement travel, and wherein the displacement travel is divided into uniform increments, which are determined by the control gate of the flat key.

7. The lock device according to claim 1, wherein the stop of at least one of the plurality of tumblers has a laterally projecting cam.

8. The lock device according to claim 1, wherein at least one of the locking edges has a recess or a recess having at least one bevel to accommodate in a region thereof a web or a web having at least one matching bevel of the locking channel.

9. The lock device according to claim 1, wherein the lock cylinder has a freewheel system.

* * * * *